United States Patent [19]

Patkos

[11] Patent Number: 4,698,871

[45] Date of Patent: Oct. 13, 1987

[54] FACIAL PAD

[76] Inventor: Ilona Patkos, 303 W. Hillcrest Blvd., Monrovia, Calif. 91016

[21] Appl. No.: 840,889

[22] Filed: Mar. 18, 1986

[51] Int. Cl.[4] ..... A45D 33/34

[52] U.S. Cl. ..... 15/118; 15/209 E

[58] Field of Search ..... 15/208, 209 R, 210 R, 15/105, 118; 132/79 D, 82 R

[56] References Cited

U.S. PATENT DOCUMENTS

| | | | |
|---|---|---|---|
| 1,357,990 | 11/1920 | Karmen . | |
| 1,565,775 | 12/1925 | Bash . | |
| 2,190,376 | 2/1940 | Daley . | |
| 2,492,278 | 12/1949 | Foster | 15/227 |
| 2,885,703 | 5/1959 | Elliott | 15/118 |
| 2,942,285 | 6/1960 | Gray | 15/209 |
| 2,958,885 | 11/1960 | Donney . | |
| 3,226,751 | 1/1966 | Lemelson | 15/118 |
| 3,955,233 | 5/1976 | Nakamura | 15/209 R |
| 4,254,530 | 3/1981 | Lambert | 15/235 |

*Primary Examiner*—Edward C. Roberts

*Attorney, Agent, or Firm*—Pretty, Schroeder, Brueggemann & Clark

[57] ABSTRACT

A pad is disclosed for removing facial powder from a compact and for applying the powder to the skin, wherein the pad includes a mesh material on a second side for abrading a surface of the facial powder the compact and for loosening the facial powder. The mesh has a thickness of between 60 and 90 mils and comprises a mesh size of approximately 400 openings per square inch.

11 Claims, 3 Drawing Figures

FACIAL PAD

BACKGROUND OF THE INVENTION

1. Field of the Invention

This invention relates to pads for applying facial cosmetics, and more specifically to facial pads having a mesh fabric in addition to a pile fabric.

2. Description of Related Art

Karmen, U.S. Pat. No. 1,357,990, shows a powder puff having a pile fabric on one side and a cloth fabric on the opposite side for trim. The pile fabric extends across one face of the pad and around the edges to the opposite face. The Karmen powder puff is similar to present pads having a single surface of a pile fabric and a fine fabric surface on the opposite side thereof for decoration or trim.

Nakamura, U.S. Pat. No. 3,955,233, shows applicators for cosmetics. The applicator surface includes a pile fabric over the entire usable surface.

Daley, U.S. Pat. No. 2,190,376 and Bash, U.S. Pat. No. 1,565,775, show applicators for cosmetics having only type of usable surface.

Lambert, U.S. Pat. No. 4,254,530, shows a pad having a soft, natural or synthetic shearing material forming one surface and a tough, nylon mesh material forming the other surface, with a polyurethane or cellulose sponge material between the two. Lambert is a cleaning and washing pad, as are Donney, U.S. Pat. No. 2,958,885; Gray, U.S. Pat. No. 2,942,285; Lemelson, U.S. Pat. No. 3,226,751; and Elliott, U.S. Pat. No. 2,885,703.

Facial powder and other powder cosmetics are typically purchased in, and applied from, compact cases containing the powder. A new compact has the facial powder in the form of compressed or caked powder. The powder is removed by rubbing the pile of the pad back and forth to remove grains of powder and to accumulate the powder on the pad. The powder is then applied as usual. With extensive use and after repeated rubbing to loosen the powder, oil from the facial pad accumulates on the surface of the compact and forms a layer of hardened powder. This layer is harder than the powder was in its original compressed form. The layer is not easily broken with the usual rubbing of the pile of the pad and if powder is loosened, the powder particles may not be small enough for suitable application. As a result, the compact is usually discarded, and a new one used. It is difficult to break up the facial powder into grain sizes sufficiently small to apply uniformly to the skin. No applicators have been designed with function in a manner other than to pick up cosmetic powder from the compact using the pile of the pad and apply the powder to the skin. A design is, therefore, needed to allow loosening of the hardened facial powder so that substantially all of the cosmetic powder can be used from the compact.

BRIEF SUMMARY OF THE INVENTION

A pad for removing facial powder from a compact and for applying the powder to the skin has a filler and a pile fabric on a first side of the filler for applying the powder to the skin. The filler forms a foundation for the pad and includes a second side on which a mesh material is placed for abrading the surface of the hardened facial powder in the compact. The mesh material loosens the facial powder and comprises a thickness of between 60 and 90 mils. The mesh comprises a count of approximately 20 threads per inch.

The pile fabric may extend around the edges of the filler to the opposite side, where the mesh material may be heat-sealed over the edges of the pile fabric. Alternatively, the mesh material may be fixed to the pile fabric with an insoluble adhesive.

DETAILED DESCRIPTION OF THE PREFERRED EMBODIMENTS

Figure 1:
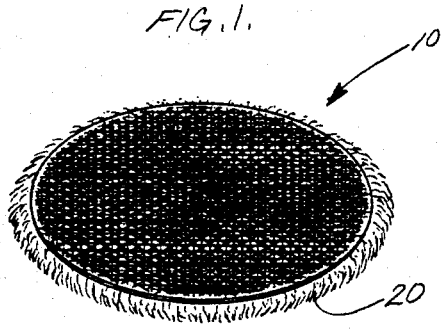
FIG. 1 is a perspective view of a pad for applying facial powder to skin embodying the present invention.
Figure 2:
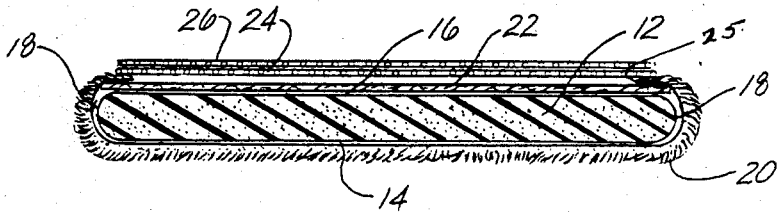
FIG. 2 is a schematic and cross section of the pad of FIG. 1 and embodying the present invention.
Figure 3:
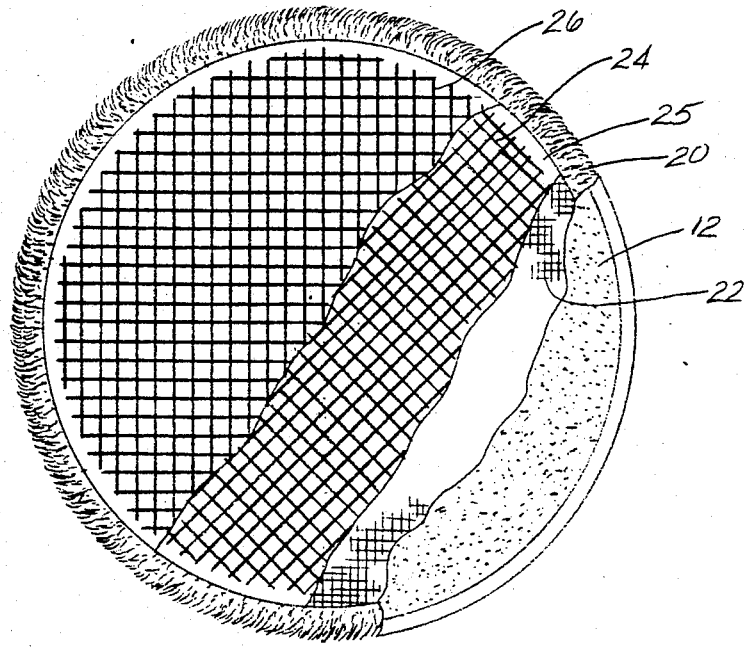
FIG. 3 is a schematic top plan view and partial cutaway of the facial pad of the present invention.

In FIGS. 1–3, there is shown a pad 10 having a filler 12. The filler includes a first face 14 and a second opposite face 16 and an edge 18. In a preferred embodiment, the filler and pad defined thereby are circular in plan view so that the edge defines a circumference of the pad. Generally, the pad is formed to fit the compact case in which it is to be placed. The filler material may be any known material used in facial pads, such as kapok or other cellular foam material. The filler is preferably nonwater-absorbent and may also be a closed cell foam.

The pad includes a pile fabric 20, such as cotton velour, covering the first face of the filler material. Preferably, the pile fabric extends over the entire first face and around the edges of the filler to the second face of the filler.

On the second face of the filler, a fabric 22, such as satin or silk, covers the second face and extends to meet the pile fabric at the edge of the filler. The fabric 22 may be bonded, sealed, or sewn to the edges of the pile fabric. Preferably, the edges of the pile fabric overlap the edges of the fabric cover so that the filler is completely enclosed. Alternatively, the fabric cover may be omitted, if desired.

A mesh material 24 is placed over the cloth fabric for use in abrading and loosening the hardened facial powder in the compact. The mesh material also extends over the filler material to the edges of the pile fabric. In the preferred embodiment, the mesh material is heat-sealed 25 to the edge of the pile fabric, thereby closing the edge around the pile fabric. In the preferred embodiment, the filler pad is slightly larger than the mesh material so that the mesh material extends over only part of the filler material. Additionally, the mesh material preferably extends over the edges of the velour pile fabric to overlap the pile fabric by about ⅛" about the circumference and is sealed thereon.

The mesh material is preferably made from nylon. Nylon has the advantage of durability and strength. However, lace or cloth may also be used. The mesh material preferably has openings of approximately 1/16" with approximately 20 openings per inch. This provides approximately 400 openings per square inch.

The preferred mesh material is a lattice material, such as the Can-Can style No. 536 of the Washington Millinery Supply, Inc. The lattice has a thickness of approximately 60 to 90 mils. The Can-Can No. 536 has approximately 20 openings per inch, giving about 400 openings per square inch. This style uses 100% nylon fibers having a denier of 40. The fabric lattice members forming the weave preferably comprise two threads each.

The mesh may have various shapes for esthetic appeal. A pleasing color, such as pink, off-white, or peach, can be used. In the preferred embodiment, the mesh and the pile fabric are of different colors, so that the user can distinguish one side of the pad from the other.

In a preferred embodiment, a second mesh 26 is placed over the first mesh material so that there are two layers of mesh material. The two layers can have lattice members extending in parallel with each other or may be skewed. The mesh fabric pieces shown in FIGS. 2 and 3 extend at angles to one another. The preferred embodiment has both pieces of the mesh material extending across the pad to cover the edges of the pile fabric extending over the edges of the filler material. However, it is possible that the mesh material can extend over only a part of the pad, leaving the remainder of the face of the pad covered only by the satin cloth.

Rather than heat-sealing the first and second layers of the mesh material to the pile fabric, the mesh material may be sewn to the edges of the pile fabric. The round pad is preferably approximately 2" in diameter and no greater than ¼" thick. This allows easy handling of the pad.

With the applicator as described, the user can easily loosen facial powder in the compact which has become hardened through facial oil buildup. As a result, less facial powder is wasted due to this hardening. The pad is also washable and, therefore, more durable than conventional pads. Though the pad may be somewhat more costly to manufacture, the additional expense may be offset by the savings in greater use of the facial powder in the compact.

The mesh fabric is chosen so that the hardened facial powder can be loosened and then used without producing particles of facial powder too large for application. The mesh is sufficiently fine to loosen the powder, but will not unnecessarily gouge the powder or create particles that are too large.

The pad is used on hardened powder by first inverting the pad so that the mesh material can be applied against the facial powder in the compact case. The mesh material may then be brushed repeatedly over the surface of the facial powder to loosen the grains of powder. When sufficient powder has been loosened for application, the pad is then inverted again so that the pile fabric can be used to brush and pick up the loosened powder from the compact. The powder retained in the pile fabric may then be applied to the skin as usual. If additional powder is needed, the process may be repeated. If there is only a small layer of hardened powder with loose powder underneath, the mesh material may be used to break and loosen the hardened surface of the facial powder. The powder may then be picked up on the pile fabric and applied to the skin. If the powder has not yet hardened from oil buildup, the pile fabric may be used as usual.

It should be noted that the above are preferred configurations, but others are foreseeable. The described embodiments of the invention are only considered to be preferred and illustrative of the invention concepts. The scope of the invention is not to be restricted to the described embodiments. Various and numerous other arrangements may be devised by one skilled in the art without departing from the spirit and scope of the invention.

What is claimed is:

1. A pad for loosening and removing facial powder from a compact and for applying a powder to the skin, the pad comprising:

a filler comprising a first side and a second side and forming a foundation for the pad;

a pile fabric on the first side for applying the powder to the skin; and a mesh material on the second side for abrading a surface of the facial powder in the compact and for loosening the facial powder, wherein the mesh material comprises a thickness between 60 and 90 mils, and wherein the mesh comprises a mesh size of approximately 400 openings per square inch.

2. The pad as claimed in claim 1 wherein the filler comprises an edge, wherein the pile fabric extends around the edge to the second side, and wherein the mesh material overlaps part of the pile fabric and comprises a heat-seal for sealing the mesh material to the pile fabric on the second side.

3. The pad as claimed in claim 1 wherein the pile fabric comprises a water-resistant pile fabric.

4. The pad as claimed in claim 3 wherein the pile fabric comprises cotton velour.

5. The pad as claimed in claim 4 wherein the filler comprises a cellular material.

6. The pad as claimed in claim 5 wherein the cellular material comprises a closed-cell cotton material.

7. The pad as claimed in claim 1 further comprising a fabric backing between the filler and the mesh material.

8. The pad as claimed in claim 1 wherein the mesh material comprises a nylon mesh material.

9. The pad as claimed in claim 8 wherein the nylon material comprises a woven nylon material.

10. The pad as claimed in claim 1 further comprising an insoluble adhesive securing the mesh material to the pile fabric.

11. The pad as claimed in claim 1 wherein the filler comprises a circular filler.

* * * * *

UNITED STATES PATENT AND TRADEMARK OFFICE

CERTIFICATE OF CORRECTION

PATENT NO. : 4,698,871

DATED : October 13, 1987

INVENTOR(S) : Ilona Patkos

It is certified that error appears in the above-identified patent and that said Letters Patent is hereby corrected as shown below:

In the Abstract, line 4, after "powder" insert -- in --.

In column 1, line 24, after "only" and before "type" insert -- one --.

In column 1, line 52, delete "with" and insert therefor -- which --.

Signed and Sealed this

Fifteenth Day of March, 1988

*Attest:*

*Attesting Officer*

DONALD J. QUIGG

*Commissioner of Patents and Trademarks*